US007394428B1

(12) United States Patent
Hsieh

(10) Patent No.: US 7,394,428 B1
(45) Date of Patent: Jul. 1, 2008

(54) SINGLE POLE PRINTED ANTENNA

(75) Inventor: Fu Mao Hsieh, Tauyuan Hsien (TW)

(73) Assignee: Joymax Electronics Co., Ltd., Chongli Gonyeh Chu, Chongli, Tauyan Hsien (TW)

( * ) Notice: Subject to any disclaimer, the term of this patent is extended or adjusted under 35 U.S.C. 154(b) by 0 days.

(21) Appl. No.: 11/644,118

(22) Filed: Dec. 22, 2006

(51) Int. Cl.
*H01Q 1/38* (2006.01)

(52) U.S. Cl. ..... 343/700 MS; 343/700 MS; 343/846; 343/731; 343/792.5; 343/829

(58) Field of Classification Search ..... 343/700 MS, 343/853, 846, 731
See application file for complete search history.

(56) References Cited

U.S. PATENT DOCUMENTS 3,806,946 A * 4/1974 Tiuri et al. ..... 343/731
4,083,046 A 4/1978 Kaloi ..... 343/700 MS
4,937,585 A * 6/1990 Shoemaker ..... 343/700 MS
5,550,554 A 8/1996 Erkocevic ..... 343/828
5,563,613 A 10/1996 Schroeder et al. ..... 343/700 MS
6,664,926 B1 * 12/2003 Zinanti et al. ..... 343/700 MS

* cited by examiner

*Primary Examiner*—Trinh V Dinh
(74) *Attorney, Agent, or Firm*—Charles E. Baxley

(57) ABSTRACT

A printed antenna includes a smaller antenna member attached onto the circuit board, one or more greater antenna members attached onto the circuit board and electrically coupled to the smaller antenna member with conductive coupling members and coupled in series with each other, a feed-in terminal electrically coupled to the smaller antenna member, and a ground member attached onto the circuit board and spaced away from the feed-in terminal for a spaced distance for increasing the gain value and the frequency bandwidth of the printed antenna. The ground member may include one or more extensions located beside the feed-in terminal and the smaller antenna member.

2 Claims, 7 Drawing Sheets

H_plane, 570 MHz

E_plane, 570 MHz

H_plane, 670 MHz

E_plane, 670 MHz

H_plane, 770 MHz

E_plane, 770 MHz

H_plane, 870 MH

E_plane, 870 MHz

| | present invention | | prior art | |
|---|---|---|---|---|
| Frequency(MHz) | E_plane(dBi) | H_plane(dBi) | E_plane(dBi) | H_plane(dBi) |
| 570 | 3.2 | 3.1 | -0.2 | -0.3 |
| 670 | 3.4 | 3.2 | -4.0 | -4.0 |
| 770 | 3.0 | 3.0 | -3.5 | -3.5 |
| 870 | 3.2 | 3.1 | -3.1 | -3.1 |

FIG. 11

SINGLE POLE PRINTED ANTENNA

BACKGROUND OF THE INVENTION

1. Field of the Invention

The present invention relates to a printed antenna, and more particularly to a single pole printed antenna including two or more antenna members coupled in series and having increased area for increasing the gain value and the frequency bandwidth.

2. Description of the Prior Art

Typical antennas comprise a radiating element for signal emitting and/or receiving purposes. For example, U.S. Pat. No. 4,083,046 to Kaloi discloses one of the typical electric monomicrostrip dipole antennas including a ground plane attached to a bottom portion of a dielectric substrates, and a radiating element attached to an upper portion of the dielectric substrates for signal emitting and/or receiving purposes.

The radiating element may be formed into various kinds of shapes or contours. However, only one radiating element is provided and attached to the upper portion of the dielectric substrates, and the gain and the frequency bandwidth may not reach the required value or level.

U.S. Pat. No. 5,550,554 to Erkocevic discloses another typical antenna apparatus comprising two L-shaped intermediate frequency amplifiers attached to a ground plane for signal emitting and/or receiving purposes. However, the L-shaped intermediate frequency amplifiers include the same shape and area or contour such that the gain and the frequency bandwidth also may not reach the required value or level.

U.S. Pat. No. 5,563,613 to Schroeder et al. discloses a further typical planar phased array antenna comprising a number of diamond shaped hollow active members attached to a plate and conductive branches electrically connecting the hollow active members in mirror symmetrical pairs. However, similarly, the diamond shaped hollow active members include the same shape and area or contour such that the gain and the frequency bandwidth also may not reach the required value or level.

The present invention has arisen to mitigate and/or obviate the afore-described disadvantages of the conventional printed antenna devices.

SUMMARY OF THE INVENTION

The primary objective of the present invention is to provide a printed antenna including two or more antenna members coupled in series and having increased area for increasing the gain value and the frequency bandwidth.

In accordance with one aspect of the invention, there is provided a printed antenna comprising a circuit board, a first antenna member attached onto the circuit board, at least one second antenna member attached onto the circuit board and electrically coupled to the first antenna member with a conductive coupling member and coupled in series with the first antenna member, a feed-in terminal electrically coupled to the first antenna member, and a ground member attached onto the circuit board and spaced away from the feed-in terminal for a spaced distance.

The feed-in terminal is electrically coupled to the first antenna member with a conductive coupling member. The second antenna member includes an area greater than that of the first antenna member.

The ground member includes at least one extension extended therefrom. The extension of the ground member located beside the feed-in terminal and the first antenna member.

Alternatively, the ground member may include two extensions extended therefrom, and the feed-in terminal and the first antenna member are located between the extensions of the ground member.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 11 is a chart illustrating the testing results or the gains of the printed antenna in accordance with the present invention and the typical antenna device.

DETAILED DESCRIPTION OF THE PREFERRED EMBODIMENT

Figure 1:
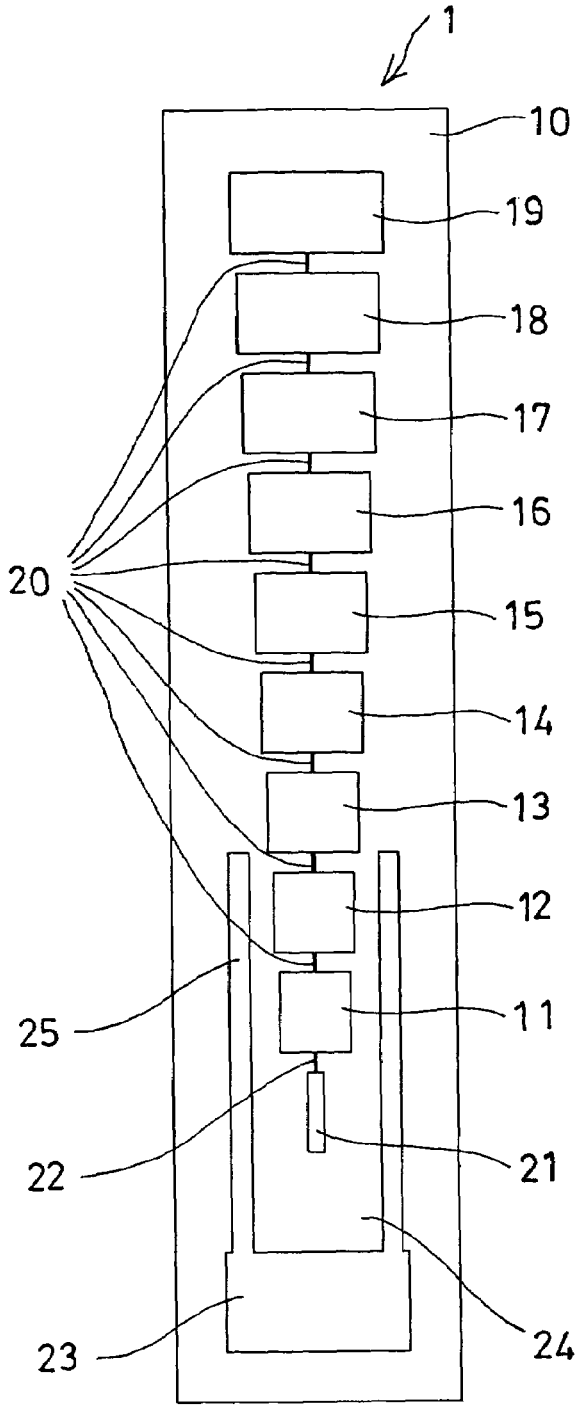
FIG. 1 is a plan schematic view of a printed antenna in accordance with the present invention.

Referring to the drawings, and initially to FIG. 1, a printed antenna 1 in accordance with the present invention comprises a ground plate or circuit board 10, a number of antenna members 11, 12, 13, 14, 15, 16, 17, 18, 19 printed or applied or attached onto the circuit board 10 and electrically coupled together with conductive coupling members 20, and coupled in series with each other, in which the antenna member 11 includes an area smaller than that of the adjacent antenna member 12 which includes an area smaller than that of the adjacent antenna member 13, and the antenna member 13 also includes an area smaller than that of the adjacent antenna member 14, for allowing the antenna members 11-19 to have an area gradually increased from the antenna member 11 to the antenna member 19.

On the contrary, the antenna member 19 includes an area greater than that of the adjacent antenna member 18 which includes an area greater than that of the adjacent antenna member 17, and the antenna member 17 also includes an area greater than that of the adjacent antenna member 16, for allowing the antenna members 11-19 to have an area gradually decreased from the antenna member 19 to the antenna member 11. The antenna members 11-19 may include or may be formed into various kinds of different shapes or contours. A feed-in terminal 21 is electrically coupled to the smallest antenna member 11 with another conductive coupling member 22 and preferably includes an area smaller than that of the smallest antenna member 11.

A ground member 23 is printed or applied or attached onto the circuit board 10 and spaced away from the feed-in terminal 21 for a spaced area or distance 24, and includes one or more (such as two) legs or extensions 25 extended from the ground member 23 and spaced away from each other and located beside the feed-in terminal 21, and one or more of the antenna members 11-19, or the feed-in terminal 21 and one or more of the antenna members 11-19 are disposed or located between the legs or extensions 25 of the ground member 23. The provision and the coupling of the antenna members 11-19 of gradually increased area may suitably increase the gain value and the frequency bandwidth for the printed antenna 1, and the test results are shown in FIGS. 2-11.

Figure 2:
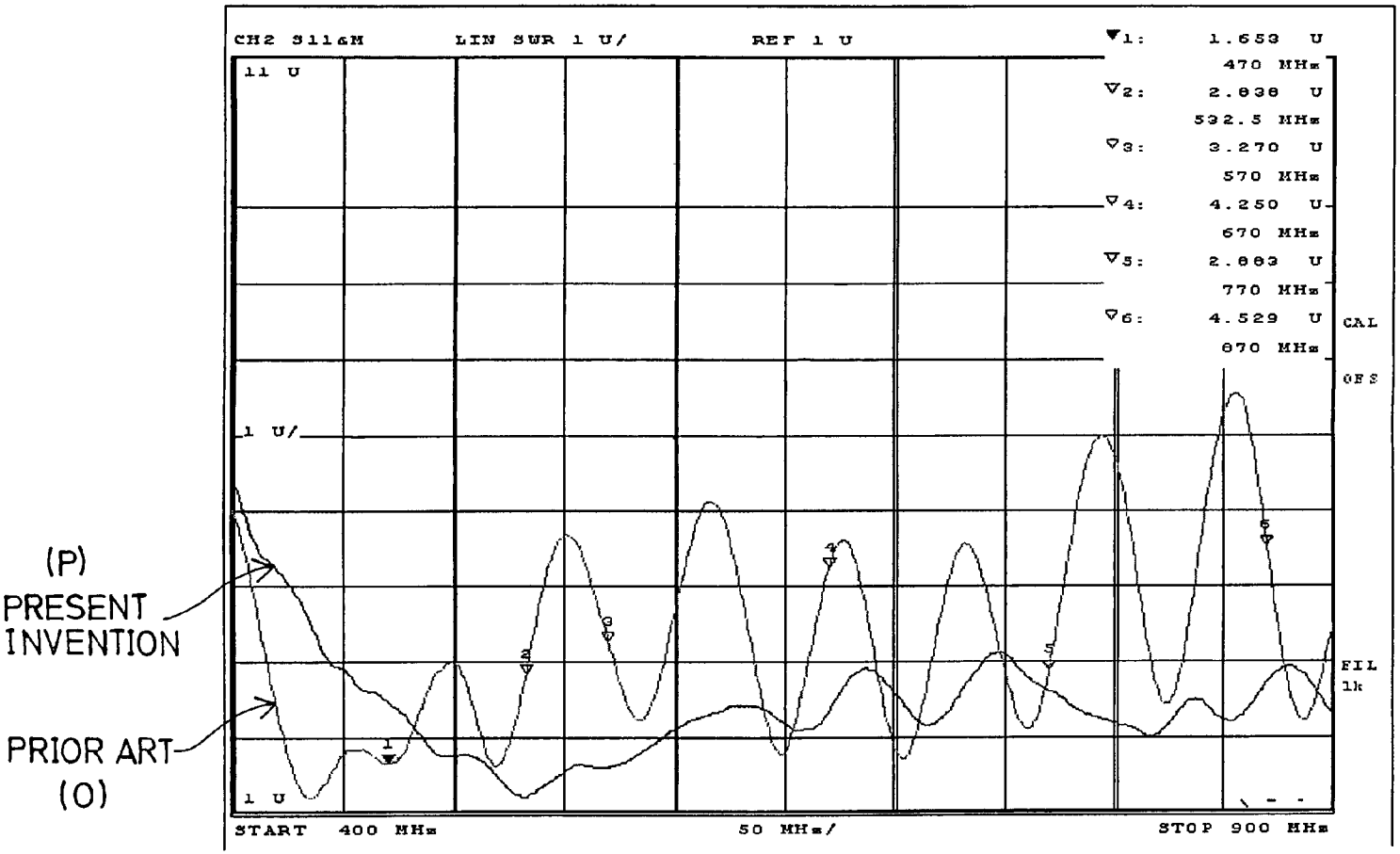
FIG. 2 is a graph illustrating the testing results of the printed antenna in accordance with the present invention and of one of the typical antenna devices.
Figure 4:
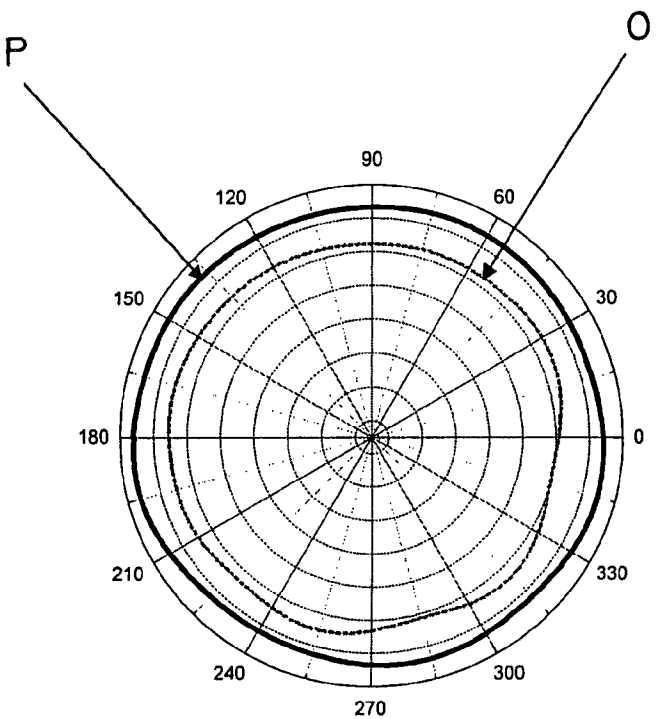
FIG. 4 depicts the radiation pattern of the printed antenna in accordance with the present invention and the typical antenna device at 570 MHz and in an H-plane.
Figure 3:
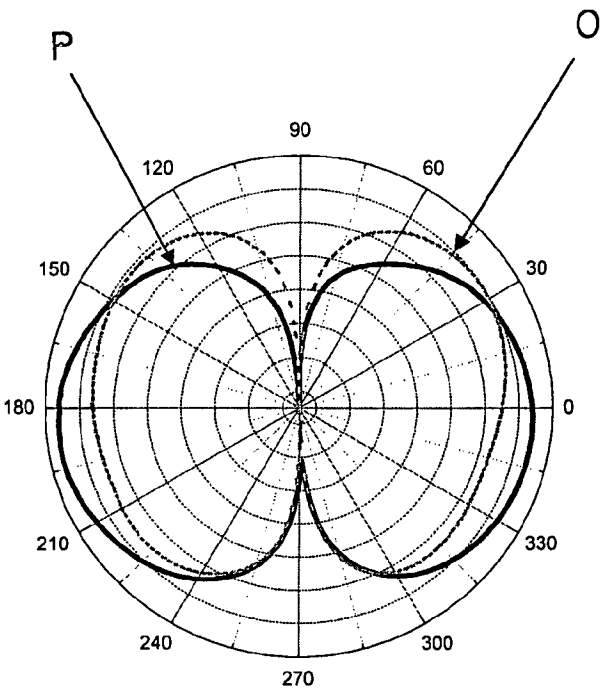
FIG. 3 depicts the radiation pattern of the printed antenna in accordance with the present invention and the typical antenna device at 570 MHz and in an E-plane.
Figure 6:
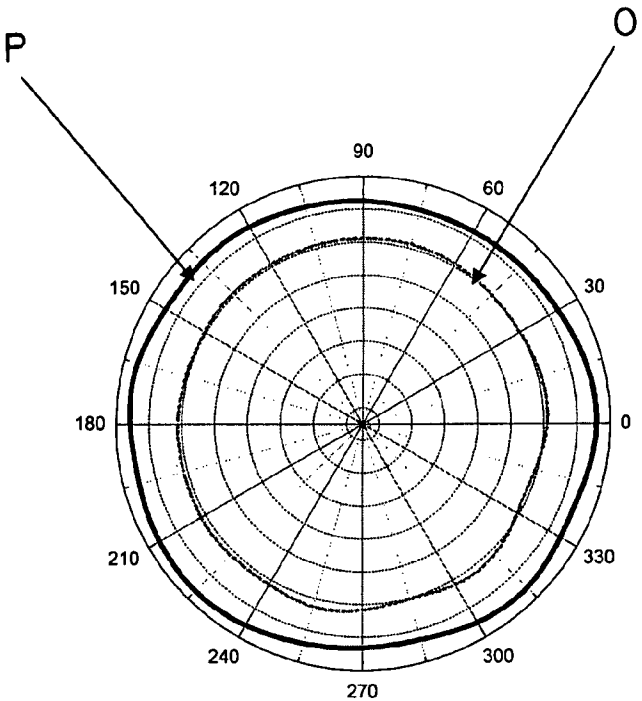
FIG. 6 depicts the radiation pattern of the printed antenna in accordance with/the present invention and the typical antenna device at 670 MHz and in an H-plane.
Figure 5:
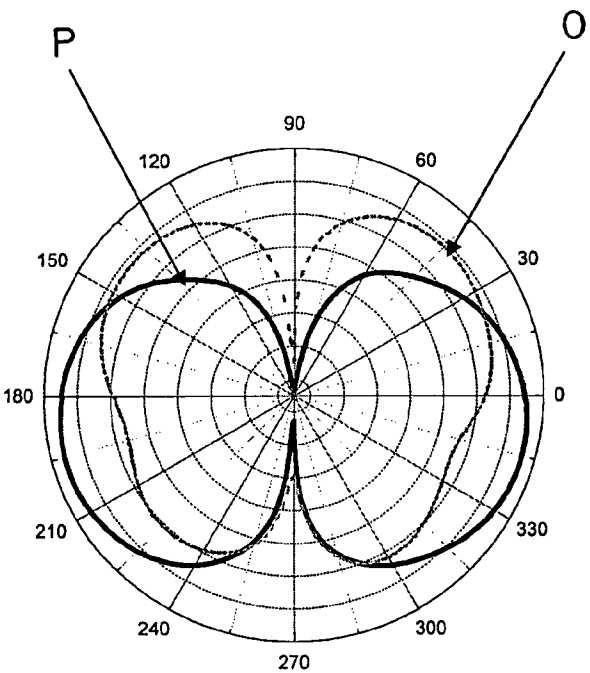
FIG. 5 depicts the radiation pattern of the printed antenna in accordance with the present invention and the typical antenna device at 670 MHz and in an E-plane.
Figure 8:
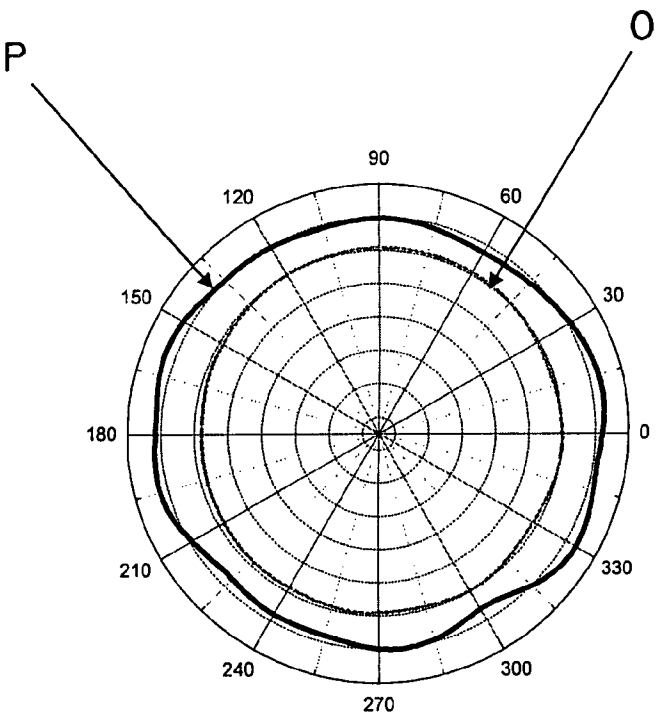
FIG. 8 depicts the radiation pattern of the printed antenna in accordance with the present invention and the typical antenna device at 770 MHz and in an H-plane.
Figure 7:
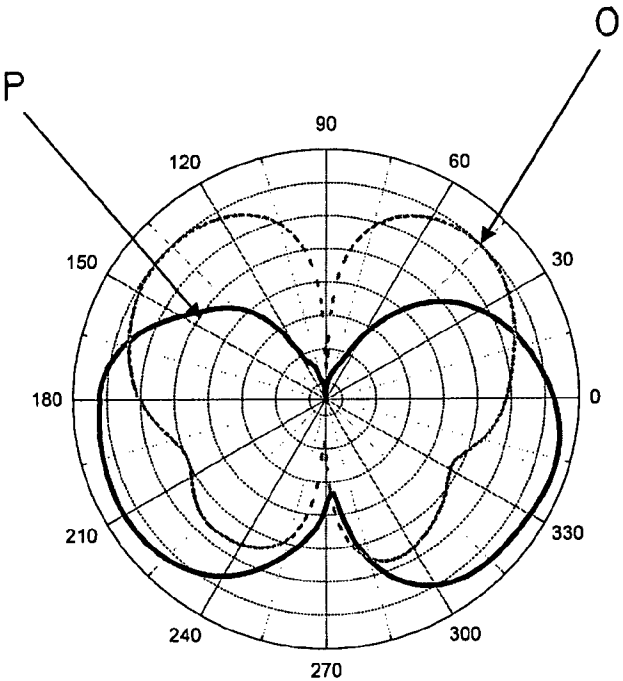
FIG. 7 depicts the radiation pattern of the printed antenna in accordance with the present invention and the typical antenna device at 770 MHz and in an E-plane.
Figure 10:
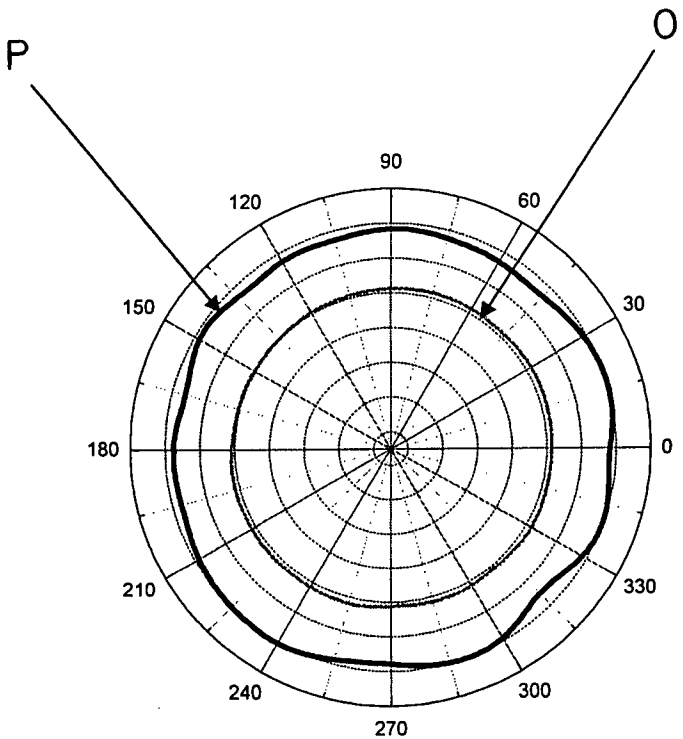
FIG. 10 depicts the radiation pattern of the printed antenna in accordance with the present invention and the typical antenna device at 870 MHz and in an H-plane.
Figure 9:
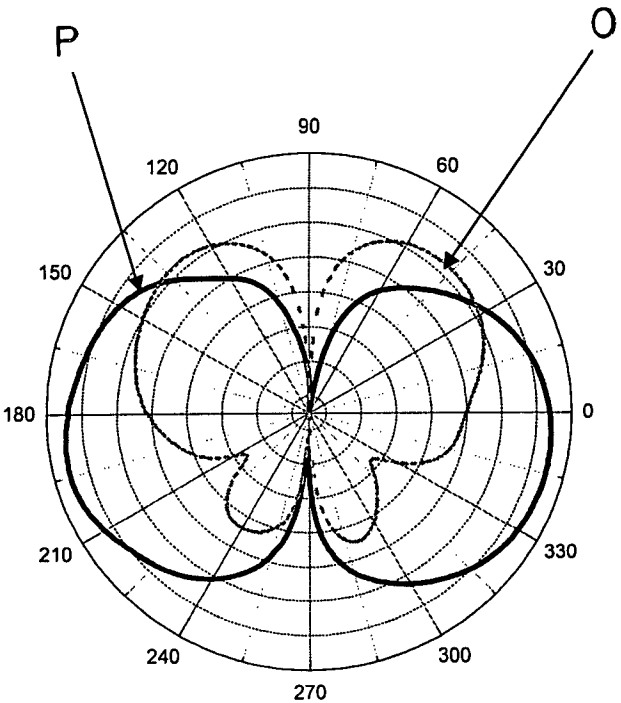
FIG. 9 depicts the radiation pattern of the printed antenna in accordance with the present invention and the typical antenna device at 870 MHz and in an E-plane.

As shown in FIG. 2, the printed antenna 1 in accordance with the present invention (P) and one of the typical antenna devices (O) are conducted with various tests under different frequencies. For example, the radiation patterns of the present invention (P) and the typical antenna device (O) are different from each other and are shown in FIGS. 3 and 4 at 570 MHz and in an erected or E-plane and in a horizontal or H-plane respectively, in which the electric field strength of the present invention (P) is greater than that of the typical antenna device (O). Similarly, as shown in FIGS. 5, 6; 7, 8; and 9, 10, the electric field strengths of the present invention (P) are also greater than that of the typical antenna device (O) at 670, 770, 870 MHz respectively and in the erected or E-plane and in the horizontal or H-plane respectively.

As shown in FIG. 11, illustrated are the gains of the printed antenna 1 in accordance with the present invention (P) and the typical antenna device (O) at different frequencies, i.e., 570 MHz, 670 MHz, 770 MHz, and 870 MHz respectively. From the test results we may see that the gains of the printed antenna 1 in accordance with the present invention (P) are much greater than that of the typical antenna device (O). In addition, the changing of the impedance of the printed antenna 1 in accordance with the present invention (P) is much smooth than that of the typical antenna device (O), or the changing of the impedance of the typical antenna device (O) is much more violent than the changing of the impedance of the printed antenna 1 in accordance with the present invention (P), best shown in FIG. 2.

It is to be noted that the typical antenna devices failed to provide a printed antenna including one or more antenna members coupled in series with each other and having an area gradually increased from the smallest antenna member 11 to the greatest antenna member 19, and a feed-in terminal 21 electrically coupled to the smallest antenna member 11 with another conductive coupling member 22 and preferably having an area smaller than that of the smallest antenna member 11.

Accordingly, the printed antenna in accordance with the present invention includes two or more antenna members coupled in series and having increased area for increasing the gain value and the frequency bandwidth.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A printed antenna comprising:

a circuit board, a first antenna member attached onto said circuit board, at least one second antenna member attached onto said circuit board and electrically coupled to said first antenna member with a conductive coupling member and coupled in series with said first antenna member, and including an area greater than that of said first antenna member, a feed-in terminal electrically coupled to said first antenna member with a conductive coupling member, and a ground member attached onto said circuit board and spaced away from said feed-in terminal for a spaced distance, and including at least two extensions extended therefrom and located beside said feed-in terminal and said first antenna member wherein said first antenna member and at least one of said at least one second antenna element are located between said extensions of said ground member.

2. A printed antenna comprising:

a circuit board, a first antenna member attached onto said circuit board, at least one second antenna member attached onto said circuit board and electrically coupled to said first antenna member with a conductive coupling member and coupled in series with said first antenna member, and including an area greater than that of said first antenna member, a feed-in terminal electrically coupled to said first antenna member with a conductive coupling member, and a ground member attached onto said circuit board and spaced away from said feed-in terminal for a spaced distance, and including two extensions extended therefrom, and said feed-in terminal said first antenna member and at least one of said at least one second antenna element being located between said extensions of said ground member.

* * * * *